US005863217A

United States Patent [19]

Ii et al.

[11] Patent Number: 5,863,217

[45] Date of Patent: Jan. 26, 1999

[54] LOCK MECHANISM FOR FPC CONNECTOR

[75] Inventors: Hidehiro Ii, Koube; Tomoaki Ito, Machida, both of Japan

[73] Assignee: Molex Incorporated, Lisle, Ill.

[21] Appl. No.: 764,889

[22] Filed: Dec. 16, 1996

[30] Foreign Application Priority Data

Mar. 28, 1996 [JP] Japan ..... 8-099397

[51] Int. Cl.[6] ..... H01R 9/07

[52] U.S. Cl. ..... 439/495

[58] Field of Search ..... 439/495, 496

[56] References Cited

U.S. PATENT DOCUMENTS

| | | | |
|---|---|---|---|
| 3,084,302 | 4/1963 | Braeutigam | 339/17 |
| 3,696,319 | 10/1972 | Olsson | 339/17 F |
| 4,629,271 | 12/1986 | Awano | 339/75 MP |
| 4,695,108 | 9/1987 | Ichitsubo | 439/59 |
| 4,734,053 | 3/1988 | Imai | 439/329 |
| 4,969,840 | 11/1990 | Ii et al. | 439/495 |
| 5,009,607 | 4/1991 | Gordon et al. | 439/496 |
| 5,194,017 | 3/1993 | Consoli | 439/492 |
| 5,397,247 | 3/1995 | Aoki et al. | 439/496 |
| 5,562,487 | 10/1996 | Ii et al. | 439/495 |

FOREIGN PATENT DOCUMENTS

| | | | |
|---|---|---|---|
| 4-11346 | 3/1992 | Japan | H01R 9/07 |

*Primary Examiner*—Gary F. Paumen
*Attorney, Agent, or Firm*—Stephen Z. Weiss

[57] ABSTRACT

An electrical connector is provided for a flat electrical cable. The connector includes a housing loaded with a plurality of terminals. An actuator is movable mounted on the housing for biasing the cable into engagement with the terminals. A latching system is operatively associated between the housing and the actuator for retaining the actuator on the housing. The latching system includes a first latch mechanism latchable in a first direction and a second latch mechanism latchable in a second direction distinct from and at an angle to the first direction.

10 Claims, 4 Drawing Sheets

LOCK MECHANISM FOR FPC CONNECTOR

FIELD OF THE INVENTION

This invention generally relates to the art of electrical connectors and, particularly, to an electrical connector for a flat cable, such as a flat flexible cable, printed circuit board or the like. Specifically, the invention relates to a latching system for connectors of the character described.

BACKGROUND OF THE INVENTION

Very generally, electrical connectors are devices provided for interconnecting electrical circuits. A typical electrical connector includes a dielectric housing, such as of plastic material or the like, which mounts a plurality of terminals terminated to the electrical circuits. The circuits may range from discrete electrical wires to circuit traces on a printed circuit board. Although the invention herein is applicable for a wide variety of electrical connectors, it is shown herein in conjunction with an electrical connector for a flat electrical cable.

Typically, an electrical connector for a flat cable includes a dielectric housing loaded with a plurality of terminals in a generally parallel array and on a given pitch. The housing has an opening or mouth for receiving the flat cable. An actuator is movably mounted on the housing for retaining the flat cable inserted into the housing and for biasing conductors of the cable against the terminals. There are various types of actuators, such as actuators which are pivotally mounted on the housing, as by an integral or living hinge portion of the plastic material. Other actuators are separate or independent of the housing, as with a sliding type actuator that moves in and out of the mouth or opening in the housing along the flat cable.

One of the problems with connectors having separate or independent actuators, such as the sliding actuators, is that the actuators have a tendency to loosen from the housing and even fall therefrom. Therefore, various latch means have been provided for holding the actuator in a first, loading position whereafter the actuator can be moved to a final, terminating position once the flat cable is inserted into the housing. Some connectors actually have two sets of latch means, one latch means for holding the actuator in its first, loading position and a second latch means for holding the actuator in its final, terminating position.

Nevertheless, the various latch means of the prior art still have proven ineffective if the actuator is jolted or unintentionally moved or skewed relative to the housing which has a tendency to disengage the latch means. For instance, a particular latch means may be effective in a given direction, but if the actuator is twisted or moved in a different direction, the actuator becomes loosened or unlatched from the housing. The present invention is directed to solving these problems by providing a unidirectional latching system in electrical connectors of the character described.

SUMMARY OF THE INVENTION

An object, therefore, of the invention is to provide a new and improved latching system in an electrical connector.

In the exemplary embodiment of the invention, the electrical connector is provided for terminating a flat electrical cable. The connector includes a housing having an opening for receiving the flat electrical cable. A plurality of terminals are mounted on the housing along the opening. An actuator is movable mounted on the housing for movement between a first, loading position allowing loading of the cable into the housing through the opening and a second, terminating position biasing the cable into engagement with the terminals. A latching system is operatively associated between the housing and the actuator for retaining the actuator in the first, loading position. The latching system includes a first latch means latchable in a first direction and a second latch means latchable in a second direction distinct from and at an angle to the first direction.

As disclosed herein, the actuator includes a resilient latch arm at each opposite side or end of the actuator and extending along opposite sides of the housing. The connector, housing and actuator are elongated, with the first direction of the first latch means being generally transverse to the connector and the second direction of the second latch means being generally longitudinally of the connector. Therefore, the first and second directions are disposed generally perpendicular to each other.

Still further, the first latch means includes a first latch hook on each of the resilient latch arms engageable with a first latch shoulder on the housing in a direction transversely of the elongated connector, and the second latch means includes a second latch hook on each arm engageable with a second latch shoulder on the housing in a direction longitudinally of the elongated connector. The latch arm is structured to be resilient in a direction longitudinally of the connector and to be stiff in a direction transversely of the connector. The first latch shoulder on the housing is disposed on a flexible latch lever. The lever is structured to be resilient in a direction transversely of the connector and to be stiff in a direction longitudinally of the connector.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
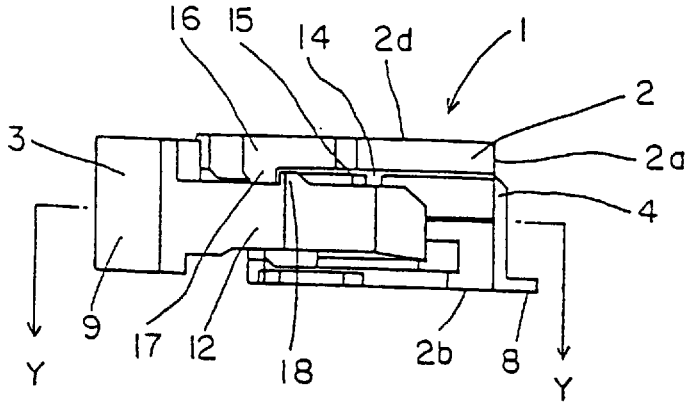
FIG. 1 is a side elevational view of a flat cable connector incorporating the latching system of the present invention, with the actuator in its first, loading position.
Figure 2:
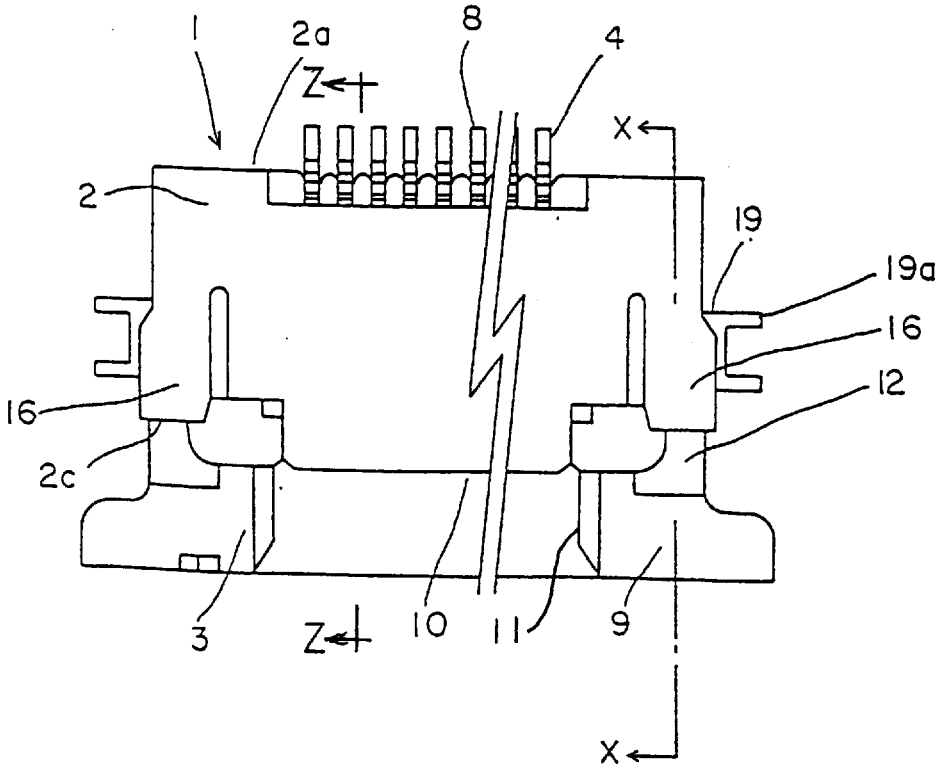
FIG. 2 is a fragmented top plan view of the connector.
Figure 3:
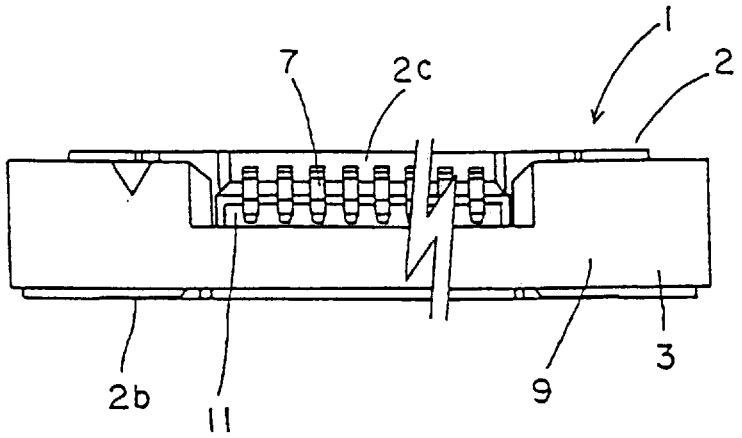
FIG. 3 is a fragmented front elevational view of the connector.

Referring to the drawings in greater detail, and first to FIGS. 1–3, the invention is embodied in an electrical connector, generally designated 1, for a flat cable, such as a flat flexible cable. The connector includes a housing 2 and an actuator 3 of the sliding type. Each of the housing and the actuator are unitarily molded of dielectric material such as plastic or the like. A plurality of terminals 4 are stamped and formed from sheet metal material and are loaded into the housing from a rear end 2*a* thereof such that the terminals are in a generally parallel array and on a given pitch or spacing.

Figure 4:
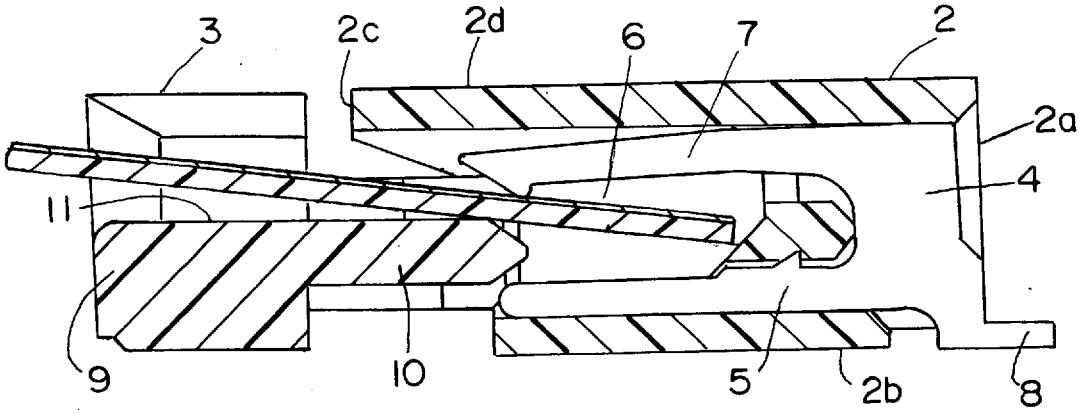
FIG. 4 is a vertical section taken generally along line Z—Z of FIG. 2.

FIGS. 1–3, along with FIG. 4, show the connector with actuator 3 in its first, loading position relative to housing 2. FIG. 4 shows that each terminal 4 is bifurcated to define a press-fitting leg 5 forced into housing 2 by a press-fit engagement. A second contact leg 7 of the bifurcated terminal is freely movable in a cavity 6 for resiliently engaging a conductor on the flat electrical cable. A solder tail 8 projects from the rear of the terminal outwardly of the housing and lies substantially flush with a bottom surface 2*b* of housing 2, so that all of the solder tails are arranged outside the housing for soldering to appropriate circuit traces on a printed circuit board.

Actuator 3 includes an operating portion 9 and a retaining plate or tongue 10. The retaining plate is inserted from a front end 2*c* of housing 2 into a terminating position within cavity 6. The retaining plate is opposed to resilient contact legs 7 of terminals 4 and sandwiches the flat cable between the plate and the contact legs, thereby electrically interengaging conductors on the cable with the terminals. A cut-out 11 is formed in the top of operating portion 9 of actuator 3 to define a passage through which the flat cable can be inserted to a position within bifurcated terminals 4, while the actuator is in its first, loading position shown in FIGS. 1–4.

Figure 5:
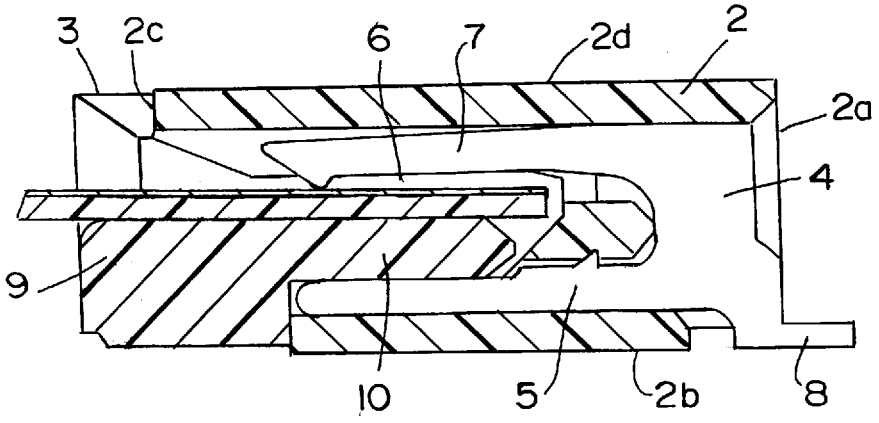
FIG. 5 is a view similar to that of FIG. 4, with the actuator in its final, terminating position.

Generally, actuator 3 is slidably movable relative to housing 2 from the first, loading position shown best in FIG. 4 to a second, terminating position shown best in FIG. 5. In the loading position, the actuator allows loading of the cable into the housing through passage 11 in the actuator. In the terminating position, the actuator biases the cable into engagement with resilient contact legs 7 of terminals 4. The cable can be released from the connector by moving the actuator back from its terminating position (FIG. 5) to its loading position (FIG. 4). The present invention is directed to a latching system which holds the actuator in its first, loading position. However, the omni-directional aspects of the latching system are equally applicable, generally, for holding two connector parts other than those described and shown herein.

The latching system of the invention is operatively associated between housing 2 and actuator 3 for retaining the actuator in the first, loading position and includes a first latch means latchable in a first direction and a second latch means latchable in a second direction distinct from and at an angle to the first direction. The latch means centers around a pair of resilient latch arms 12 at opposite sides of actuator 3 and extending rearwardly along opposite sides of housing 2. For directional purposes hereinafter, connector 1, housing 2 and actuator 3 are elongated in a direction left-to-right in FIGS. 2 and 3. With this understanding, resilient latch arms 12 are structured to be resilient in a direction longitudinally of the connector and to be stiff in a direction transversely of the connector. Viewing the latch arms relative to the inserted flat cable, the latch arms are resilient in a direction generally parallel to the plane of the cable, and the latch arms are stiff in a direction generally perpendicular to the cable.

Figure 7:
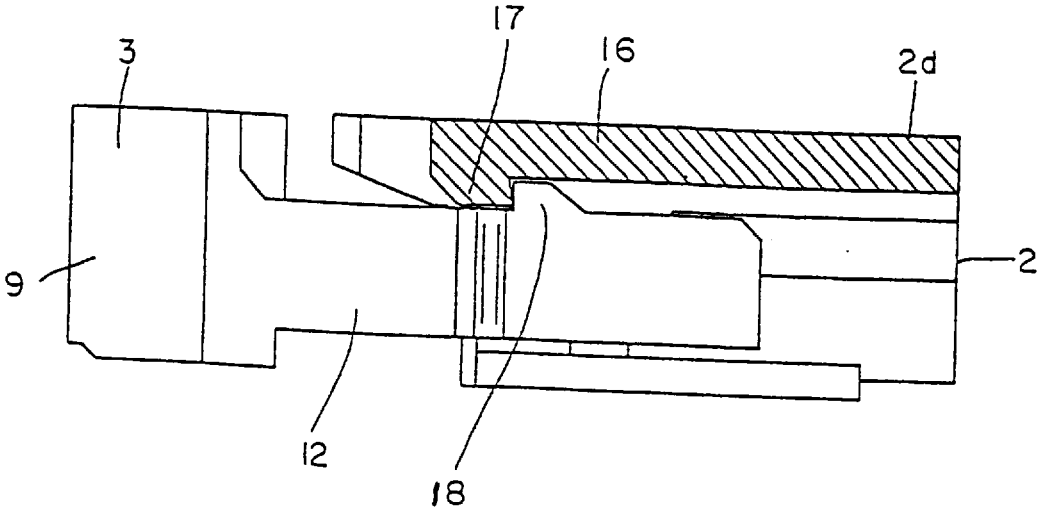
FIG. 7 is a vertical section taken generally along line X—X of FIG. 2.

In addition, housing 2 has a pair of flexible latch levers 16 which are best seen in FIGS. 2 and 7. The latch levers are structured to be resilient in a direction transversely of the connector and to be stiff in a direction longitudinally of the connector. In relation to a flat cable inserted into the connector, flexible latch levers 16 are resilient in a direction generally perpendicular to the plane of the cable, and the latch levers are stiff in a direction generally parallel to the cable. In other words, flexible latch levers 16 are resilient in a direction generally perpendicular to the direction in which flexible latch arms 12 are resilient.

As stated above, the latch system of the invention contemplates first and second latch means latchable in different directions at angles to each other. The first latch means is provided by a latch hook 18 on each resilient latch arm 12 engageable behind a latch shoulder 17 on the underside of each flexible latch lever 16, as shown clearly in FIGS. 1 and 7. Therefore, while latch hooks 18 on resilient latch arms 12 are fairly rigid against movement, latch shoulders 17 can flex with flexible latch levers 16.

Figure 6:
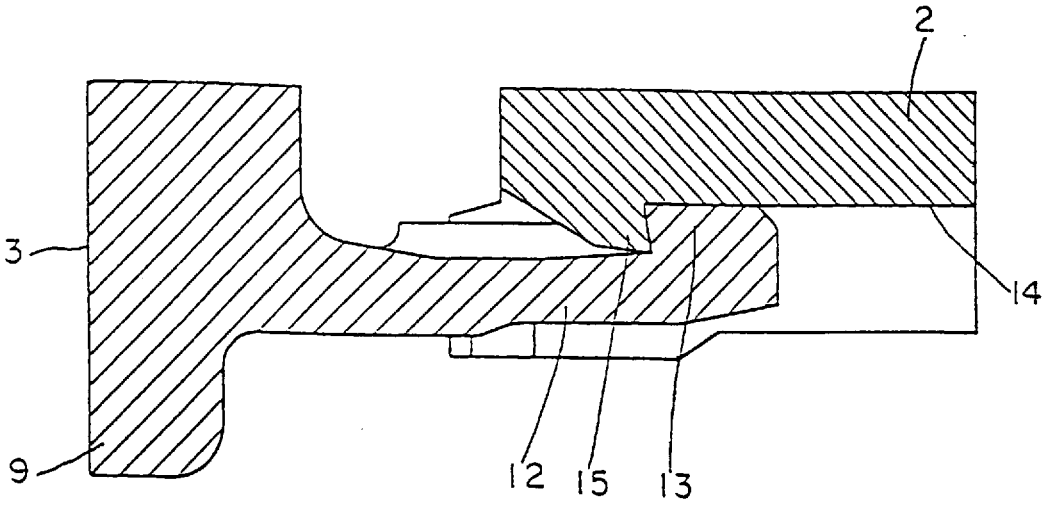
FIG. 6 is a vertical section taken generally along line Y—Y of FIG. 1.

The second latch means of the latch system is best shown in FIG. 6 wherein a latch hook 13 is shown on the inside of each resilient latch arm 12 for engagement behind a latch shoulder 15 on the side of housing 2. With this second latch means and the flexibility of latch arms 12 longitudinally of the connector, latch hooks 13 can flex while latch shoulders 15 are rigid with the housing.

With the two latch means of the latch system of the invention, a sort of omni-directional system is provided. In other words, if actuator 3 is moved or twisted generally in a horizontal direction relative to the housing, the second latch means provided by latch hooks 13 and latch shoulders 15 (FIG. 6) might have a tendency to become loosened or disengaged, but the first latch means provided by latch hooks 18 and latch shoulders 17 will remain interengaged regardless of the relative horizontal movement between the actuator and the housing. Similarly, if the actuator is moved or skewed relative to the housing in a generally vertical direction, the first latch means provided by latch hooks 18 and latch shoulders 17 might have a tendency to become disengaged, but the second latch means provided by latch hooks 13 and latch shoulders 15 (FIG. 6) will remain engaged regardless of the relative horizontal movement between the actuator and the housing.

Reference numeral 19 denotes a metal fixture mounted on a side wall 14 of housing 2, with tail portions 19*a* of the fixture generally flush with bottom surface 2*b* of the housing. The tail portions of the fixtures are adapted for surface mounting on the printed circuit board along with solder tails 8 of terminals 4.

It should be understood that in the preferred embodiment of the invention, resilient latch arms 12 and resilient latch levers 16 are flexible or displaceable in different directions generally perpendicular to each other. This provides the maximum range of angular movement between the actuator and the housing which the latches can counteract to prevent disengagement of the actuator from the housing. However, in principal, the direction of displacement of resilient latch arms 12 and flexible latch levers 16 can be at different angles other than perpendicular, within the concepts of the invention, and depending upon the particular design of the connector. In addition, while solder tails 8 of terminals 4 are shown to be flush mounted for soldering to circuit traces on a printed circuit board, the solder tails may be configured for insertion into holes in the printed circuit board. This also is true of tail portions 19*a* of metal fixtures 19.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An electrical connector for terminating a flat electrical cable, comprising:

a housing having an opening for receiving the flat electrical cable;

a plurality of terminals on the housing along said opening;

an actuator movably mounted on the housing for movement between a first, loading position allowing loading of the cable into the housing through said opening and a second, terminating position biasing the cable into engagement with the terminals;

a latching system operatively associated between the housing and the actuator for retaining the actuator in said first, loading position including a first latch means latchable in a first direction and a second latch means latchable in a second direction distinct from and at an angle to said first direction, said first and second directions being disposed generally perpendicular to each other;

the connector, housing and actuator are elongated with said first direction of the first latch means being generally transverse to the connector and said second direction of the second latch means being generally longitudinally of the connector; and said actuator including at least one resilient latch arm projecting toward the housing, said first latch means includes a first latch hook on the arm and engageable with a first latch shoulder on the housing in a direction transversely of the elongated connector and said second latch means includes a second latch hook on the arm and engageable with a second latch shoulder on the housing in a direction longitudinally of the elongated connector.

2. The electrical connector of claim 1 wherein said latch arm is structured to be resilient in a direction longitudinally of the connector and to be stiff in a direction transversely of the connector.

3. The electrical connector of claim 2 wherein said first latch shoulder on the housing is disposed on a flexible latch lever.

4. The electrical connector of claim 3 wherein said flexible latch lever is structured to be resilient in a direction transversely of the connector and to be stiff in a direction longitudinally of the connector.

5. The electrical connector of claim 2, including one of said latch arms at each opposite side of the actuator and extending along opposite sides of the housing.

6. An electrical connector for a flat electrical cable, comprising:

a housing loaded with a plurality of terminals;

an actuator movably mounted on the housing for biasing the cable into engagement with the terminals;

a latching system operatively associated between the housing and the actuator for retaining the actuator on the housing, including a first latch means latchable in a first direction and a second latching means latchable in a second direction distinct from and at an angle to said first direction, said first and second directions being disposed generally perpendicular to each other;

the connector, housing and actuator being elongated with said first direction of the first latch means being generally transverse to the connector and said second direction of the second latch means being generally longitudinally of the connector; and said actuator including at least one resilient latch arm projecting toward the housing, said first latch means includes a first latch hook on the arm and engageable with a first latch shoulder on the housing in a direction transversely of the elongated connector and said second latch means includes a second latch hook on the arm and engageable with a second latch shoulder on the housing in a direction longitudinally of the elongated connector.

7. The electrical connector of claim 6 wherein said latch arm is structured to be resilient in a direction longitudinally of the connector and to be stiff in a direction transversely of the connector.

8. The electrical connector of claim 7 wherein said first latch shoulder on the housing is disposed on a flexible latch lever.

9. The electrical connector of claim 8 wherein said flexible latch lever is structured to be resilient in a direction transversely of the connector and to be stiff in a direction longitudinally of the connector.

10. The electrical connector of claim 7, including one of said latch arms at each opposite side of the actuator and extending along opposite sides of the housing.

* * * * *